US007250724B2

(12) United States Patent
Kim

(10) Patent No.: US 7,250,724 B2
(45) Date of Patent: Jul. 31, 2007

(54) PLASMA DISPLAY PANEL INCLUDING DUMMY ELECTRODES IN NON-DISPLAY AREA

(75) Inventor: Young Dae Kim, Busan Kwangycok-shi (KR)

(73) Assignee: LG Electronics Inc., Seoul (KR)

( * ) Notice: Subject to any disclaimer, the term of this patent is extended or adjusted under 35 U.S.C. 154(b) by 498 days.

(21) Appl. No.: 10/657,257

(22) Filed: Sep. 9, 2003

(65) Prior Publication Data

US 2004/0051456 A1 Mar. 18, 2004

(30) Foreign Application Priority Data

Sep. 12, 2002 (KR) ..... 10-2002-0055455

(51) Int. Cl.
*H01J 17/49* (2006.01)

(52) U.S. Cl. ..... 313/583; 313/582

(58) Field of Classification Search ..... 313/582–583
See application file for complete search history.

(56) References Cited

U.S. PATENT DOCUMENTS 4,550,998 A * 11/1985 Nishikawa ..... 118/691
4,575,751 A 3/1986 Duschl
5,574,553 A 11/1996 McManamon et al.
5,777,436 A 7/1998 Lepselter
5,852,347 A * 12/1998 Marcotte ..... 315/169.4
5,939,826 A 8/1999 Ohsawa et al.
5,982,082 A 11/1999 Janning
6,048,243 A 4/2000 Kosaka et al.
6,055,030 A 4/2000 Izumi
6,097,151 A 8/2000 Kim et al.
6,118,214 A * 9/2000 Marcotte ..... 313/582
6,259,505 B1 7/2001 Makino
6,275,273 B1 8/2001 Inoue
6,297,590 B1 * 10/2001 Nanto et al. ..... 313/586
6,337,028 B1 1/2002 Masuko et al.
6,353,288 B1 3/2002 Asano et al.
6,380,678 B1 4/2002 Kim
6,580,216 B1 6/2003 Lu et al.
6,597,113 B1 7/2003 Nitta
6,600,265 B1 7/2003 Ebihara et al.
6,621,231 B1 9/2003 Kwon
6,650,051 B1 11/2003 Park et al.
6,720,736 B2 4/2004 Lee et al.
6,821,177 B2 * 11/2004 Mitomo ..... 445/24

(Continued)

FOREIGN PATENT DOCUMENTS

JP 60-9029 1/1985

(Continued)

*Primary Examiner*—Karabi Guharay
(74) *Attorney, Agent, or Firm*—Ked & Associates, LLP

(57) ABSTRACT

A plasma display panel having an active area and a non-display area positioned at the outside of the active area wherein dummy electrodes positioned within said non-display area have a narrower gap between electrodes than sustain electrode pairs positioned within said active area. Accordingly, the plasma display panel has a narrower gap between electrodes of the dummy electrodes than the sustain electrode pair within the active area and has a narrow electrode width thereof, so that it can easily generate a discharge between the dummy electrodes well and reduce a generation of electric charges accumulated onto the dummy electrodes. As a result, the plasma display panel can prevent an abnormal discharge to improve a picture quality.

26 Claims, 10 Drawing Sheets

W1 < W2 , G1 < G2

U.S. PATENT DOCUMENTS

| | | | | |
|---|---|---|---|---|
| 2001/0050533 | A1 | 12/2001 | Hirose | 313/583 |
| 2002/0003515 | A1 | 1/2002 | Lee et al. | 345/60 |
| 2002/0175631 | A1* | 11/2002 | Kim | 315/169.1 |
| 2004/0021653 | A1* | 2/2004 | Kim et al. | 345/204 |

FOREIGN PATENT DOCUMENTS

| | | | |
|---|---|---|---|
| JP | 03167590 | A * | 7/1991 |
| JP | 5-114362 | | 5/1993 |
| JP | 8-293253 | | 11/1996 |
| JP | 9-129142 | | 5/1997 |
| JP | 9-320475 | | 12/1997 |
| JP | 10-069858 | | 3/1998 |
| JP | 10-269951 | | 10/1998 |
| JP | 10-275563 | | 10/1998 |
| JP | 11-7897 | | 1/1999 |
| JP | 11-25866 | | 1/1999 |
| JP | 11-250812 | | 9/1999 |
| JP | 11-265661 | | 9/1999 |
| JP | 2000-306512 | | 11/2000 |
| KR | 2000-0060375 | | 10/2000 |
| KR | 2001-48515 | | 6/2001 |

* cited by examiner

W1 = W2 , G1 = G2

W1 < W2 , G1 < G2

PLASMA DISPLAY PANEL INCLUDING DUMMY ELECTRODES IN NON-DISPLAY AREA

BACKGROUND OF THE INVENTION

1. Field of the Invention

This invention relates to a plasma display panel, and more particularly to a plasma display panel that is adaptive for preventing an abnormal discharge occurring from a non-display area to thereby enhance a picture quality and reliability.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Also, the PDP is available in the current market and shows a high occupation rate in the large-dimension flat panel market.

Referring to FIG. 1, a discharge cell of a conventional three-electrode, AC surface-discharge PDP includes a sustain electrode pair having a scan electrode Y and a sustain electrode Z provided on an upper substrate 1, and an address electrode X provided on a lower substrate 2. Each of the scan electrode Y and the sustain electrode Z consists of a transparent electrode and a metal bus electrode having a smaller line width than a line width of the transparent and provided at one edge of the transparent electrode.

On the upper substrate 1 provided with the scan electrode Y and the sustain electrode Z, an upper dielectric layer 6 and an MgO protective layer 7 are disposed. A lower dielectric layer 4 are formed on the lower substrate 2 provided with the address electrode X in such a manner to cover the address electrode X. Barrier ribs are formed vertically above the lower dielectric layer 4. A phosphorous material 5 is coated onto the surfaces of the lower dielectric layer 4 and the barrier ribs 3. An inactive mixture gas such as He+Xe, Ne+Xe or He+Ne+Xe is injected into a discharge space provided among the upper substrate 1, the lower substrate 2 and the barrier ribs 3.

Such a PDP makes a time-divisional driving of one frame, which is divided into various sub-fields having a different emission frequency, so as to realize gray levels of a picture. Each sub-field is again divided into an initialization period (or reset period) for initializing the entire field, an address period for selecting a scan line and selecting the cell from the selected scan line and a sustain period for expressing gray levels depending on the discharge frequency. The initialization period is divided into a set-up interval supplied with a rising ramp waveform and a set-down interval supplied with a falling ramp waveform.

For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period and the number of sustain pulses assigned thereto are increased at a ratio of $2^n$ (wherein n=0, 1, 2, 3, 4, 5, 6 and 7) at each sub-field.

FIG. 3 shows a driving waveform of the PDP shown in FIG. 1.

Referring to FIG. 3, the PDP is divided into an initialization period for initializing the full field, an address period for selecting a cell, and a sustain period for sustaining a discharge of the selected cell for its driving.

In the initialization period (or the reset period), a rising ramp waveform Ramp-up is applied to all the scan electrodes Y in a set-up interval SU. A discharge is generated within the cells of the full field with the aid of the rising ramp waveform Ramp-up. By this set-up discharge, positive wall charges are accumulated onto the address electrode X and the sustain electrode Z while negative wall charges are accumulated onto the scan electrode Y.

In a set-down interval SD, a falling ramp waveform Ramp-down falling from a positive voltage lower than a peak voltage of the rising ramp waveform Ramp-up is simultaneously applied to the scan electrodes Y after the rising ramp waveform Ramp-up was applied. The falling ramp waveform Ramp-down causes a weak erasure discharge within the cells to erase a portion of excessively formed wall charges. Wall charges enough to generate a stable address discharge are uniformly left within the cells with the aid of the set-down discharge. Herein, such a waveform applied during the initialization period may be referred to as "reset pulse".

In the address period, a negative scanning pulse scan is sequentially applied to the scan electrodes Y and, at the same time, a positive data pulse data is applied to the address electrodes X in synchronization with the scanning pulse scan. A voltage difference between the scanning pulse scan and the data pulse data is added to a wall voltage generated in the initialization period to thereby generate an address discharge within the cells supplied with the data pulse data. Wall charges enough to cause a discharge when a sustain voltage is applied are formed within the cells selected by the address discharge.

Meanwhile, a positive direct current voltage Zdc is applied to the sustain electrodes Z during the set-down interval and the address period. The direct current voltage Zdc causes a set-down discharge between the sustain electrode Z and the scan electrode Y, and establishes a voltage difference between the sustain electrode Z and the scan electrode Y or between the sustain electrode Z and the address electrode X so as not to make a strong discharge between the scan electrode Y and the sustain electrode Z in the address period.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge, that is, a display discharge between the scan electrode Y and the sustain electrode Z whenever the sustain pulse sus is applied.

Just after the sustain discharge was finished, a ramp waveform ramp-ers having a small pulse width and a low voltage level is applied to the sustain electrode Z to thereby erase wall charges left within the cells of the entire field.

As shown in FIG. 4 and FIG. 5, each of an upper non-display area 32 positioned at the upper outside of an active area 31 for displaying a picture and a lower non-display area 33 positioned at the lower outside thereof is provided with a discharge space having the same structure as the discharge cell at the active area 31. In other words, dummy electrodes UDE and BDE are formed in the same pattern as the sustain electrode pair Y and Z within the active area 31. Accordingly, each of the upper non-display area 32 and the lower non-display area 33 is provided with the address electrode X and the dummy electrodes UDE and BDE, and is provided with the dielectric layers 4 and 6 in such a manner to cover the electrodes X, UDE and BDE. The dummy electrodes UDE and BDE provided at each of the upper non-display area 32 and the lower non-display area 33 causes a discharge at the non-display area upon aging process, to thereby stabilize discharge characteristics of discharge cells at the first horizontal line and the nth horizontal line of the active area 31 in the same condition as other discharge cells of the active area 31. To this end, a voltage capable of causing a discharge upon aging process is applied to the dummy electrodes UDE and BDE, and a voltage is not applied thereto after the aging process.

However, the conventional PDP has a problem in that a discharge is generated accidentally from the upper non-display area 32 and the lower non-display area 33. Such a discharge is defined by "abnormal discharge". More specifically, if a discharge, such as an initialization discharge, address discharge or a sustain discharge, etc., occurs upon driving of the PDP, then space charges generated by such a discharge are accumulated onto dielectric layers of the upper non-display area 32 and the lower non-display area 33. For instance, as shown in FIG. 6, upon address discharge, a negative scanning pulse scan is sequentially applied to the scan electrodes Y1 to Yn to thereby move positive space charges 52 into the lower non-display area 33 and, at the same time, move negative space charges 51 into the upper non-display area 32. The space charges 51 and 52 having been moved into the non-display areas 32 and 33 in this manner are accumulated within the non-display areas 32 and 33 and onto the dielectric layers 4 and 6 covering the electrodes at the active area 31 adjacent to the non-display areas 32 and 33. If a wall voltage 61 of the discharge space raised by wall charges accumulated onto the non-display areas 32 and 33 and the active area 31 adjacent thereto becomes more than a voltage Vf enough to cause a discharge, then an abnormal discharge is generated accidentally within the non-display areas 32 and 33 and the active area 31 adjacent thereto. As shown in FIG. 8, such an abnormal discharge allows a visible light 71 generated from the non-display areas 32 and 33 and the upper/lower edge of the active area 31 adjacent thereto to be viewed by an observer. In the more serious case, due to such a normal discharge, the PDP cannot display a picture for several seconds and further damages the discharge cell. Also, the PDP has a problem in that its reliability is deteriorated due to a circuit break phenomenon caused by the abnormal discharge in which a very large current flows suddenly through a scan driving circuit mounted at the scan driver and an address driving circuit mounted at the address driver to burn each circuit chip. Such a normal discharge becomes more serious as the brightness or the resolution of the PDP is higher.

In order to overcome the normal discharge, there has been suggested a scheme that applies a reset pulse applied in the initialization period to the dummy electrode upon driving of the PDP to thereby discharge charges flowing into the dummy electrode and erase them continuously. However, such a conventional scheme fails to completely eliminate an abnormal discharge generated at the PDP.

SUMMARY OF THE INVENTION

Accordingly, it is an object of the present invention to provide a plasma display panel that is adaptive for preventing an abnormal discharge occurring from a non-display area to thereby enhance a picture quality and a reliability.

In order to achieve these and other objects of the invention, a plasma display panel according to one embodiment of the present invention has an active area on which a picture is displayed and a non-display area positioned at the outside of the active area, wherein dummy electrodes positioned within said non-display area have a different gap between electrodes from sustain electrode pairs positioned within said active area.

In the plasma display panel, the gap between electrodes of said dummy electrodes is narrower than that of said sustain electrode pairs.

In the plasma display panel, said dummy electrodes are formed from a transparent electrode and a metal electrode.

In the plasma display panel, said dummy electrodes have a narrower electrode width than said sustain electrode pairs.

In the plasma display panel, said transparent electrodes are formed from a non-conductive metal electrode.

In the plasma display panel, said transparent electrodes are formed from a conductive metal.

In the plasma display panel, said transparent electrodes are formed from a resin material.

In the plasma display panel, said dummy electrodes have a different electrode width from said sustain electrode pairs.

A plasma display panel has an active area on which a picture is displayed and a non-display area positioned at the outside of the active area, wherein dummy electrodes positioned within said non-display area include metal electrode.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 9:
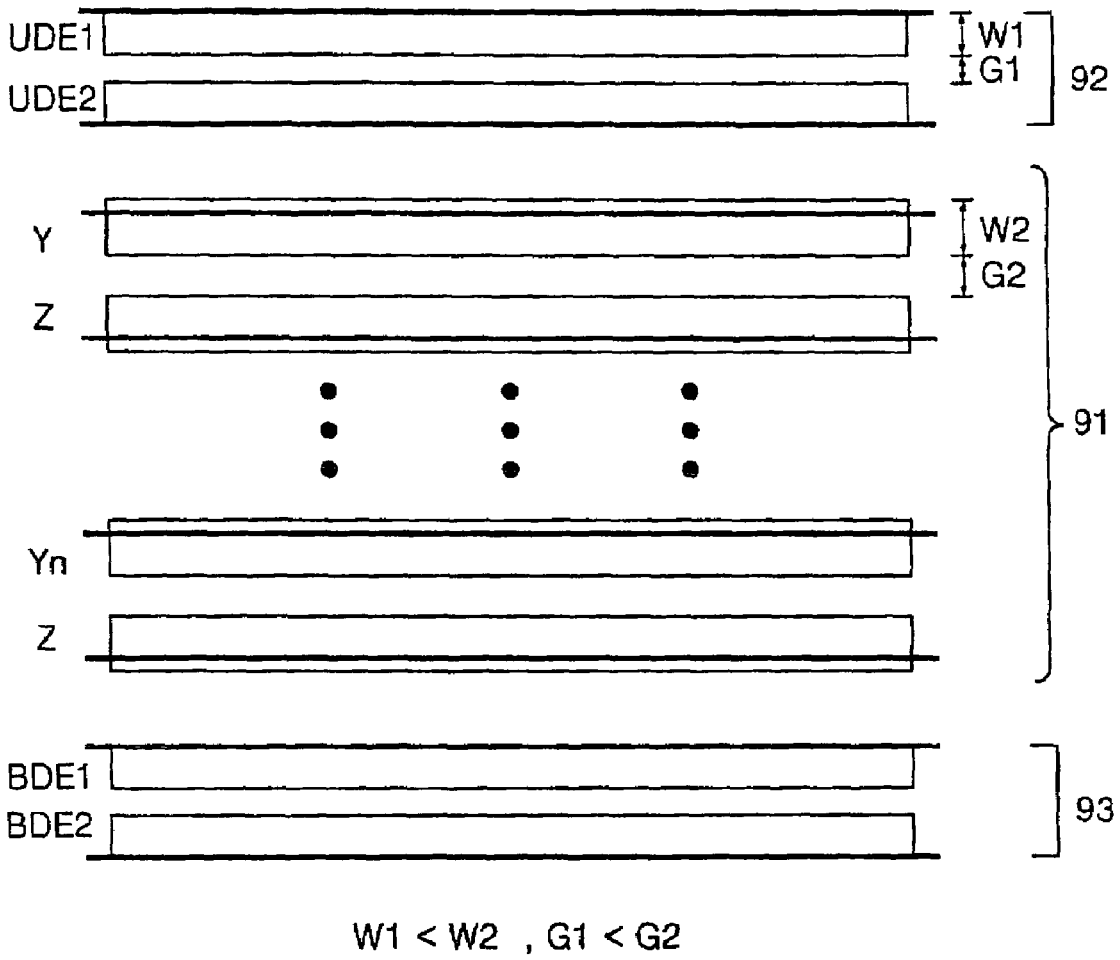
FIG. 9 is a plan view of a plasma display panel for representing electrodes at a non-display area in a plasma display panel according to a first embodiment of the present invention.

Referring to FIG. 9, a plasma display panel (PDP) according to a first embodiment of the present invention includes a sustain electrode pair Y and Z at an active area 91 on which a picture is displayed, and upper dummy electrodes DUE1 and DUE2 and lower dummy electrodes BDE1 and BDE2 having a smaller gap g1 between electrodes than the sustain electrode pair Y and Z at the active area 91 and a narrow width w1 between electrodes. The upper dummy electrodes UDE1 and UDE2 are formed at an upper non-display region 92, and the lower dummy electrodes BDE1 and BDE2 are formed at a lower non-display region 93.

Figure 10:
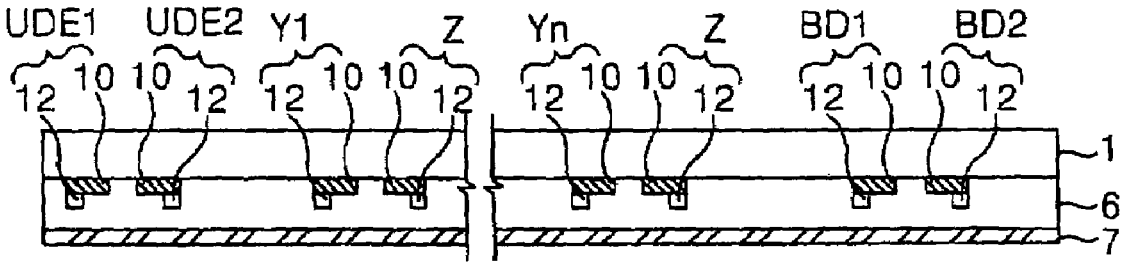
FIG. 10 is a sectional view of a plasma display panel according to a first embodiment of the present invention shown in FIG. 9.

Each of the sustain electrode pair Y and Z, the dummy electrodes UDE1 and UDE2 and lower dummy electrodes BDE1 and BDE2 comprises, as shown in FIG. 10, the transparent electrode 10 and the metal bus electrode 12 formed at an edge of the transparent electrode 10 having a narrower line width than that of the transparent electrode 10. Such a transparent electrode 10 is formed from a non-conductive metal, a conductive metal and a resin material.

The PDP according to the first embodiment will be described in conjunction with FIG. 9 to FIG. 10 below.

The scan electrode Y and the sustain electrode Z of the sustain electrode pair are provided on an upper substrate of the PDP within an active area. The dummy electrodes UDE1, UDE2, BDE1 and BDE2 are provided on the upper substrate of the PDP within a non-display area positioned above and below the active area. Address electrodes (not shown) are provided on a lower substrate of the PDP in such a manner to cross the electrodes UDE1, UDE2, BDE1, BDE2, Y and Z on the upper substrate.

The upper/lower dummy electrodes UDE1, UDE2, BDE1 and BDE2 have a narrower gap g1 between electrodes than a width w2 of the sustain electrode pair Y and Z at the active area so that a discharge between electrodes can be easily generated well. Also, the upper/lower dummy electrodes UDE1, UDE2, BDE1 and BDE2 have a narrower gap g1 between electrodes than a gap g2 between electrodes within the sustain electrode pair Y and Z at the active area 91 so that a discharge can be easily generated well. Furthermore, each dummy electrode UDE1, UDE2, BDE1 and BDE2 has a narrower electrode width w1 than the width w2 of the sustain electrode pair Y and Z at the active area 91 so as to generate a small charge amount at the surface of the electrode.

Accordingly, in the PDP according to the first embodiment, a gap between electrodes of the dummy electrodes provided at the non-display area is formed narrowly and also an electrode width is formed narrowly. Thus, the PDP according to the first embodiment can be more easily and better discharged than the dummy electrodes within the conventional PDP upon discharge caused by a reset pulse applied in the initialization period, and can generate a strong discharge at the dummy electrodes to thereby erase much a lot of accumulated electric charges. As a result, the PDP according to the first embodiment of the present invention can restrain an abnormal discharge at the dummy electrodes provided at the non-display area.

Figure 11:
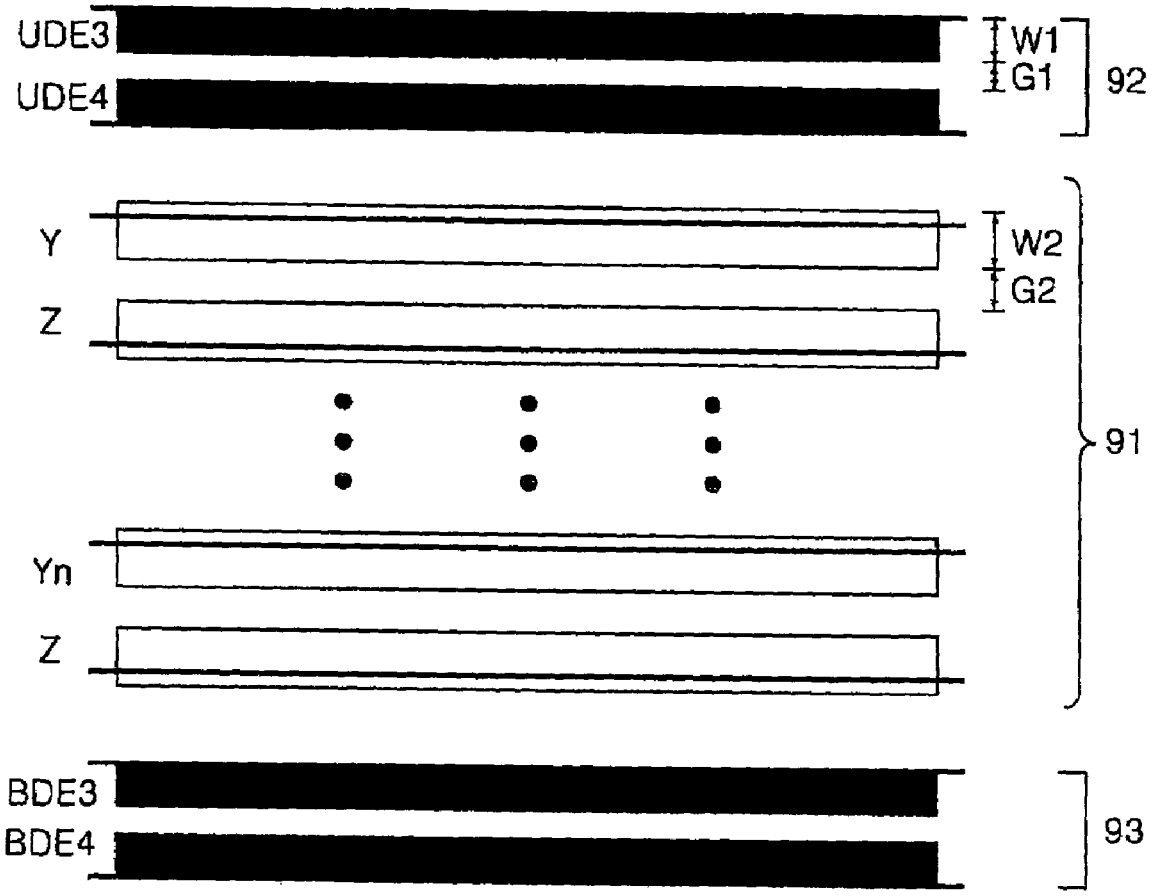
FIG. 11 is a plan view of a plasma display panel for representing electrodes at a non-display area in a plasma display panel according to a second embodiment of the present invention.

FIG. 11 shows a PDP according to a second embodiment of the present invention.

Referring to FIG. 11, the PDP according to the second embodiment includes a sustain electrode pair Y and Z at an active area 91 on which a picture is displayed, and upper dummy electrodes DUE3 and DUE4 and lower dummy electrodes BDE3 and BDE4 which have a smaller gap g1 between electrodes than the sustain electrode pair Y and Z at the active area 91 and a narrow width w1 between electrodes and are made only of a metal electrode.

Figure 1:
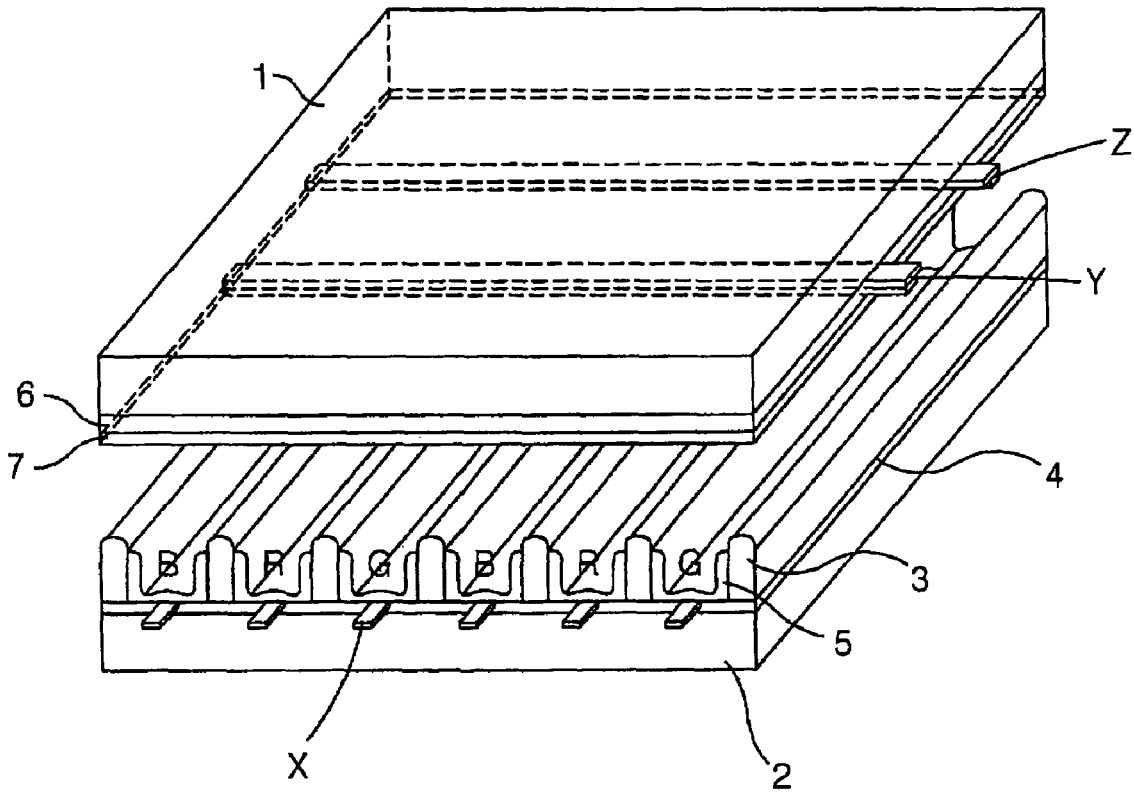
FIG. 1 RELATED ART
FIG. 1 is a perspective view showing a discharge cell structure of a conventional three-electrode, AC surface-discharge plasma display panel (PDP)
Figure 2:
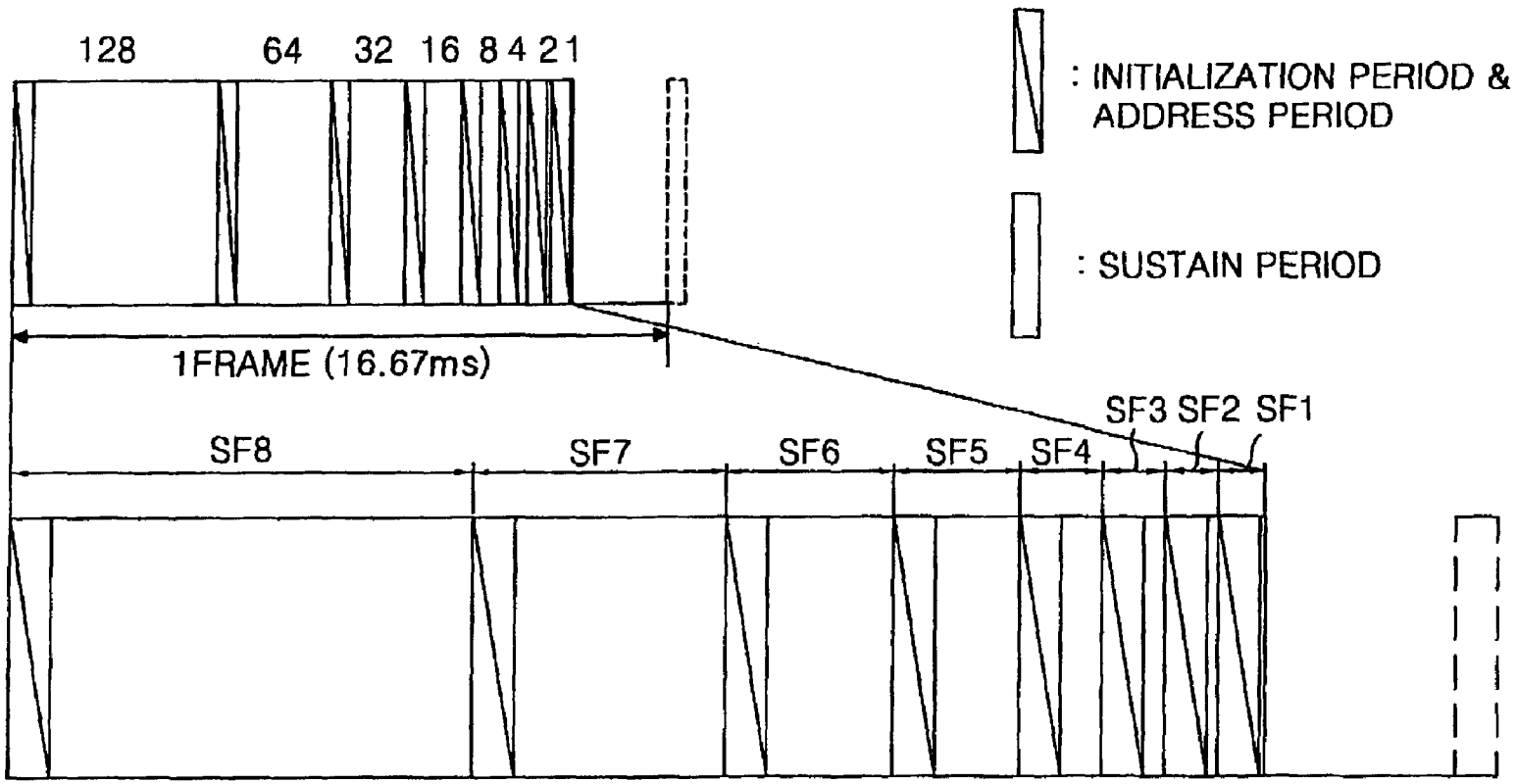
FIG.2 RELATED ART
FIG. 2 illustrates a frame configuration for implementing 256 gray levels.
Figure 3:
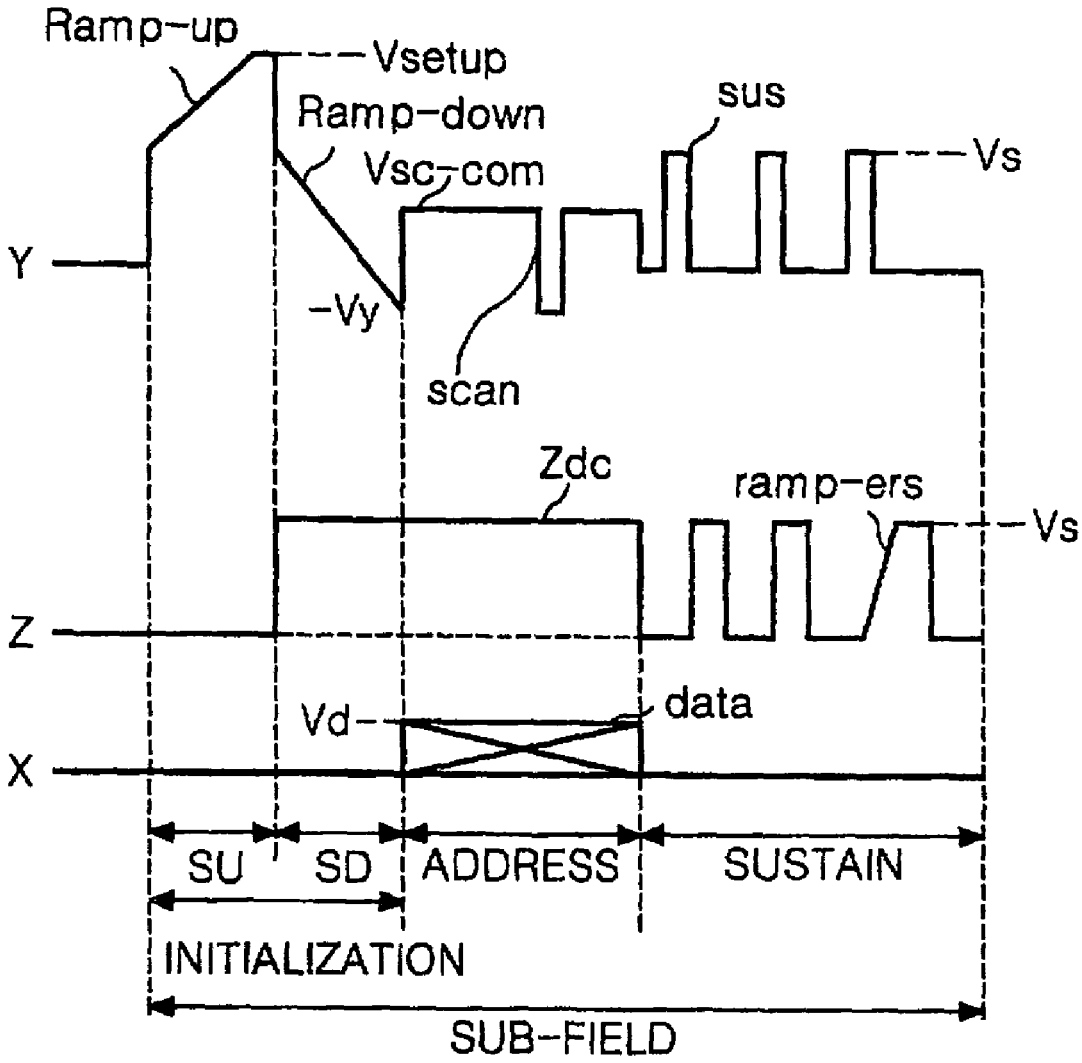
FIG.3 RELATED ART
FIG. 3 is a waveform diagram of driving signals for driving the conventional PDP.
Figure 4:
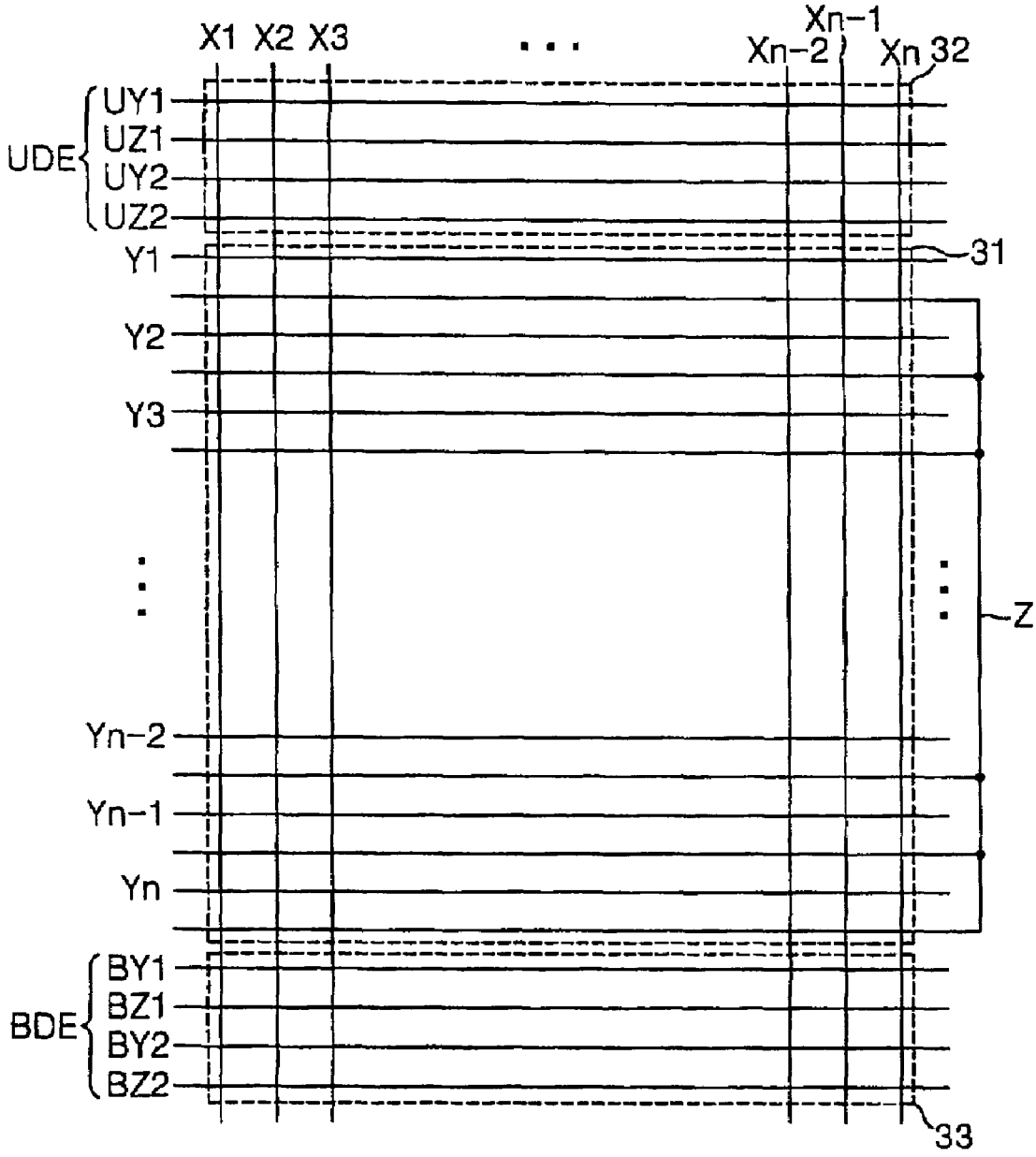
FIG. 4 RELATED ART
FIG. 4 is a plan view of the PDP for representing a non-display area.
Figure 5:
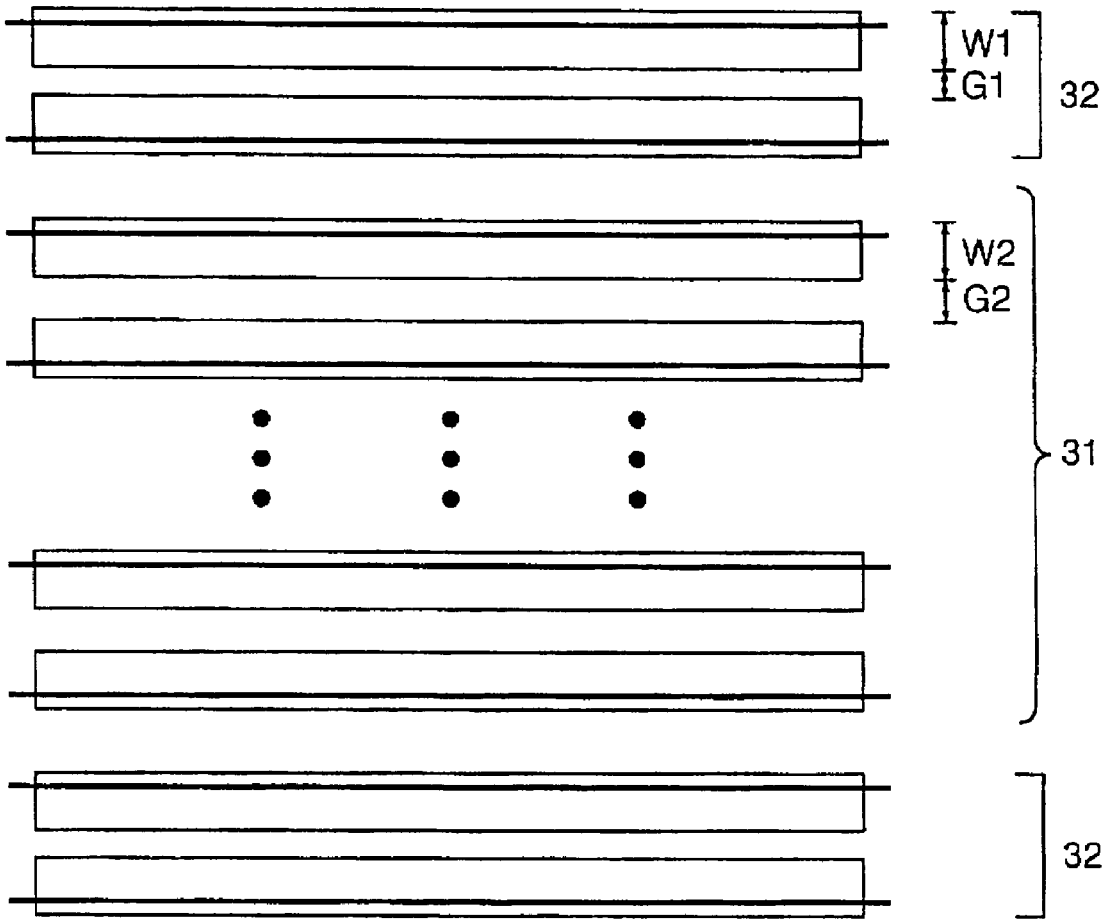
FIG. 5 RELATED ART
FIG. 5 is a plan view of the PDP for representing electrodes at the non-display area shown in FIG. 4.
Figure 6:
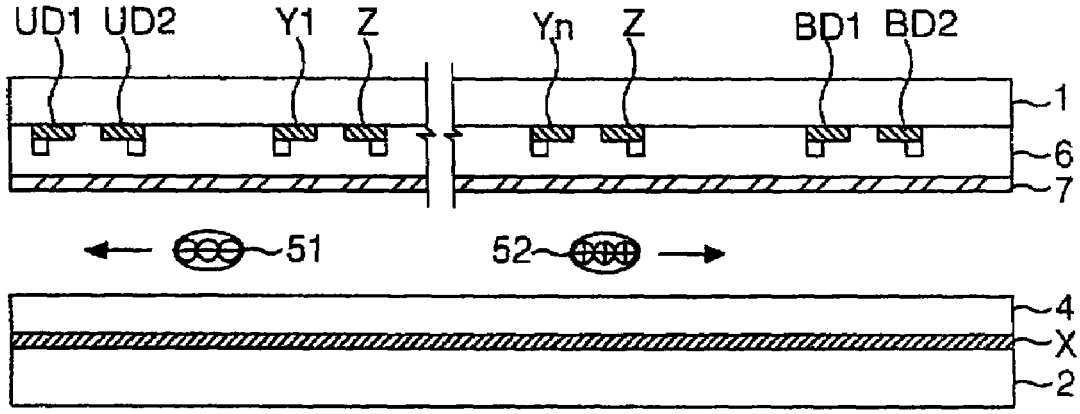
FIG. 6 RELATED ART
FIG. 6 is a section view of the PDP for representing the non-display area.
Figure 7:
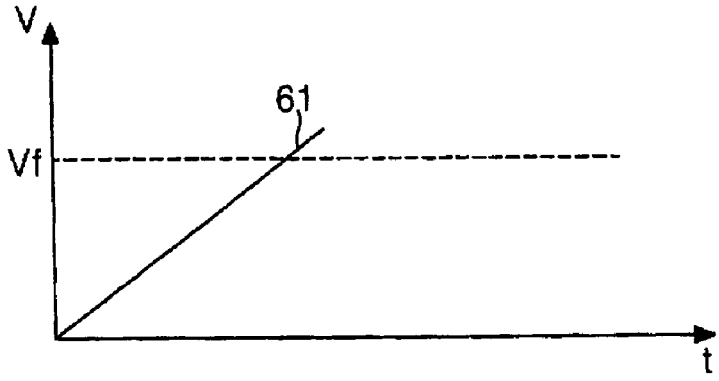
FIG. 7 RELATED ART
FIG. 7 is a graph representing a wall charge rising continuously at the non-display area.
Figure 8:
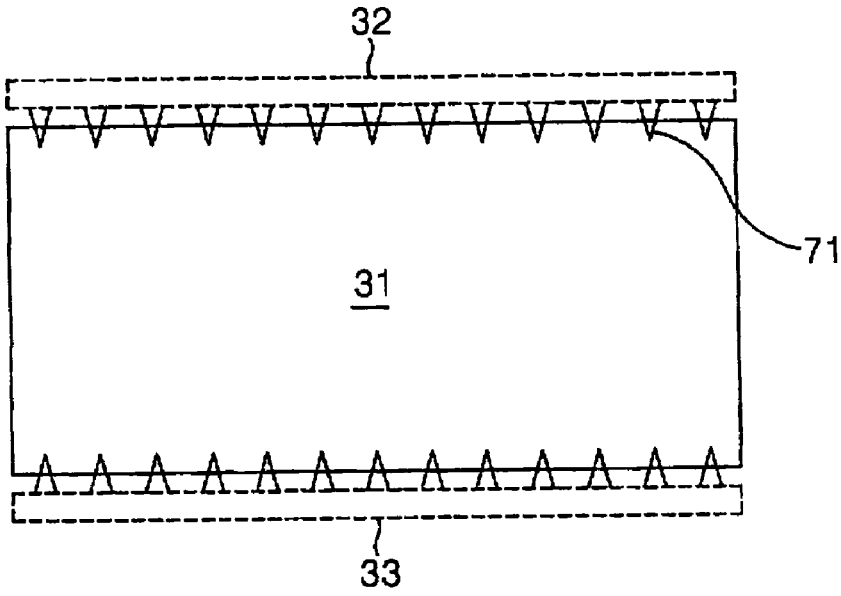
FIG. 8 RELATED ART
FIG. 8 schematically depicts a visible light generated from the non-display area and recognized at an active area of the PDP.

The PDP according to the second embodiment will be described in conjunction with FIG. 1 to FIG. 3 below.

The scan electrode Y and the sustain electrode Z of the sustain electrode pair are provided on an upper substrate of the PDP within an active area. The dummy electrodes UDE3, UDE4, BDE3 and BDE4 are provided on the upper substrate of the PDP within a non-display area positioned above and below the active area. Address electrodes (not shown) are provided on a lower substrate of the PDP in such a manner to cross the electrodes UDE3, UDE4, BDE3, BDE4, Y and Z on the upper substrate.

The upper/lower dummy electrodes UDE3, UDE4, BDE3 and BDE4 have a narrower gap g1 between electrodes than a width w2 of the sustain electrode pair Y and Z at the active area so that a discharge between electrodes can be easily generated well. Also, the upper/lower dummy electrodes UDE3, UDE4, BDE3 and BDE4 have a narrower gap g1 between electrodes than a gap g2 between electrodes within the sustain electrode pair Y and Z at the active area so that a discharge can be easily generated well. Furthermore, each dummy electrode UDE3, UDE4, BDE3 and BDE4 has a narrower electrode width w1 than the width w2 of the sustain electrode pair Y and Z at the active area 91 so as to generate a small charge amount at the surface of the electrode.

Accordingly, in the PDP according to the second embodiment, a gap between electrodes of the dummy electrodes provided at the non-display area is formed narrowly and also an electrode width is formed narrowly. Thus, the PDP according to the second embodiment can be more easily and better discharged than the dummy electrodes within the conventional PDP upon discharge caused by a reset pulse applied in the initialization period, and can generate a strong discharge at the dummy electrodes to thereby erase much a lot of accumulated electric charges. As a result, the PDP according to the first embodiment of the present invention can restrain an abnormal discharge at the dummy electrodes provided at the non-display area.

In addition, the PDP according to the second embodiment of the present invention has the dummy electrodes made of only a metal electrode. This does not allow a light emitted upon plasma discharge to be transmitted into the picture display area when a reset pulse is applied to the dummy electrodes provided within the non-display area to cause a plasma discharge because the dummy electrodes are formed from a material having no light transmission. Accordingly, it becomes possible to improve a picture quality.

As described above, the PDP according to the present invention has a narrower gap between electrodes of the dummy electrodes than the sustain electrode pair within the active area and has a narrow electrode width thereof, so that it can easily generate a discharge between the dummy electrodes well and reduce a generation of electric charges accumulated onto the dummy electrodes. As a result, the PDP according to the present invention can prevent an abnormal discharge to thereby improve a picture quality.

Furthermore, the PDP according to the present invention can restrain an abnormal discharge to thereby prevent a break phenomenon of the address driving circuit and the scan driving circuit caused by a very large current flowing into the dummy electrodes upon abnormal discharge in the conventional PDP. Accordingly, it becomes possible to assure a reliability of the PDP.

Moreover, the PDP according to the present invention forms the dummy electrodes provided within the non-display area from a material having no light transmission, thereby shutting off a light generated upon plasma discharge caused by a reset pulse applied in the initialization period. Accordingly, it becomes possible to improve a picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel having an active area on which a picture is displayed and a non-display area positioned at an outside of the active area, wherein dummy electrodes positioned within said non-display area have a different gap between electrodes as compared to a gap between a scan electrode and a sustain electrode forming a sustain electrode pair positioned within said active area, wherein the gap between electrodes of said dummy electrodes is narrower than the gap between the scan electrode and the sustain electrode forming the sustain electrode pair.

2. The plasma display panel as claimed in claim 1, wherein said dummy electrodes are formed from a transparent electrode and a metal electrode.

3. The plasma display panel as claimed in claim 2, wherein said dummy electrodes have a narrower electrode width than the electrodes of the sustain electrode pair.

4. The plasma display panel as claimed in claim 2, wherein said transparent electrodes are formed from a non-conductive metal.

5. The plasma display panel as claimed in claim 4, wherein said dummy electrodes have a narrower electrode width than the electrodes of the sustain electrode pair.

6. The plasma display panel as claimed in claim 2, wherein said transparent electrodes are formed from a conductive metal electrode.

7. The plasma display panel as claimed in claim 6, wherein said dummy electrodes have a narrower electrode width than the electrodes of the sustain electrode pair.

8. The plasma display panel as claimed in claim 2, wherein said transparent electrodes are formed from a resin material.

9. The plasma display panel as claimed in claim 8, wherein said dummy electrodes have a narrower electrode width than the electrodes of the sustain electrode pair.

10. The plasma display panel as claimed in claim 1, wherein each dummy electrode includes a transparent electrode and a bus electrode.

11. A plasma display panel having an active area on which a picture is displayed and a non-display area positioned at an outside of the active area, wherein dummy electrodes positioned within said non-display area have a different electrode width as compared to a width of a sustain electrode or a scan electrode forming a sustain electrode pair positioned within said active area, wherein each of said dummy electrodes is formed from a transparent electrode and a metal electrode.

12. The plasma display panel as claimed in claim 11, wherein said dummy electrodes have a narrower electrode width than the electrodes of the sustain electrode pair.

13. The plasma display panel as claimed in claim 11, wherein said dummy electrodes have a narrower electrode width than the electrodes of the sustain electrode pair.

14. The plasma display panel as claimed in claim 13, wherein said transparent electrodes are formed from non-conductive metal.

15. The plasma display panel as claimed in claim 13, wherein said transparent electrodes are formed from conductive metal.

16. The plasma display panel as claimed in claim 13, wherein said transparent electrodes are formed from resin material.

17. The plasma display panel as claimed in claim 11, wherein each dummy electrode includes a transparent electrode and a bus electrode.

18. The plasma display panel as claimed in claim 11, wherein address electrodes traverse the dummy electrodes and the sustain electrode and the scan electrode forming the sustain electrode pair.

19. A plasma display panel having an active area and a non-active area, the panel comprising:

first and second electrodes extending across at least a portion of the non-active area; and at least one sustain electrode pair formed of a sustain electrode and a scan electrode, the at least one sustain electrode pair extending across at least a portion of the active area, wherein a gap between the first electrode and the second electrode is of a different distance than a gap between the sustain electrode and the scan electrode forming the at least one sustain electrode pair, wherein the gap between the first electrode and the second electrode is narrower than the gap between the scan electrode and the sustain electrode forming the at least one sustain electrode pair.

20. The plasma display panel as claimed in claim 19, wherein the first electrode includes a transparent electrode and a bus electrode and the second electrode includes another transparent electrode and another bus electrode.

21. The plasma display panel as claimed in claim 19, further comprising address electrodes traversing the first electrode, the second electrode, and the sustain and scan electrodes forming the sustain electrode pair.

22. The plasma display panel as claimed in claim 19, wherein each of said first and second electrodes have a narrower electrode width than the sustain and scan electrodes of the at least one sustain electrode pair.

23. A plasma display panel having an active area and a non-active area, the panel comprising:

first and second electrodes extending across at least a portion of the non-active area; and at least one sustain electrode pair formed of a sustain electrode and a scan electrode, the at least one sustain electrode pair extending across at least a portion of the active area, wherein a width of the first electrode is different than a width of the sustain electrode, and the width of the first electrode is different than a width of the scan electrode, wherein the first electrode includes a transparent electrode and a bus electrode and the second electrode includes another transparent electrode and another bus electrode.

24. The plasma display panel as claimed in claim 23, wherein each of said first and second electrodes have a narrower electrode width than the sustain and scan electrodes of the at least one sustain electrode pair.

25. The plasma display panel as claimed in claim 23, further comprising address electrodes traversing the first electrode, the second electrode, and the sustain and scan electrodes forming the at least one sustain electrode pair.

26. The plasma display panel as claimed in claim 23, wherein a gap between the first electrode and the second electrode is of a different distance than a gap between the sustain electrode and the scan electrode forming the at least one sustain electrode pair.

* * * * *